US005127344A

United States Patent [19]

Katsui

[11] Patent Number: 5,127,344

[45] Date of Patent: Jul. 7, 1992

[54] INCINERATOR AND INCINERATING METHOD EMPLOYING THE SAME

[75] Inventor: Seizo Katsui, Osaka, Japan

[73] Assignee: Kabushiki Kaisha Plantec, Osaka, Japan

[21] Appl. No.: 695,122

[22] Filed: May 3, 1991

Related U.S. Application Data

[63] Continuation-in-part of Ser. No. 478,396, Feb. 12, 1990, Pat. No. 5,020,453.

[30] Foreign Application Priority Data

Oct. 23, 1990 [JP] Japan ..... 2-286667

[51] Int. Cl.[5] ..... F23G 5/00; F23G 5/12

[52] U.S. Cl. ..... 110/255; 110/256; 110/257; 110/346

[58] Field of Search ..... 110/256, 346, 229, 225, 110/257, 259, 255

[56] References Cited

U.S. PATENT DOCUMENTS 4,262,611 4/1981 Kuhnert et al. ..... 110/248 X
4,452,154 6/1984 Kono et al. ..... 110/256 X
4,732,092 3/1988 Gould ..... 110/256 X
4,774,896 10/1988 Michimae et al. ..... 110/256
5,020,453 6/1991 Katsui ..... 110/256 X

FOREIGN PATENT DOCUMENTS 0041709 2/1989 Japan ..... 110/250

*Primary Examiner*—Edward G. Favors
*Attorney, Agent, or Firm*—Armstrong, Nikado, Marmelstein, Kubovcik & Murray

[57] ABSTRACT

An incinerator for combustion of general refuse and industrial wastes having a pair of ash discharge plates and a pair of refuse supporting plates. The ash discharge plates are disposed at the bottom of a furnace in such a manner that it can be freely opened and closed for timely discharge of ashes that accumulate on the bottom. The refuse supporting plates are disposed at a lower level of the furnace in such a manner that it can be freely displaced in a horizontal direction out of and into the furnace projecting into an upper layer of the piled up ashes at the time of discharge of ashes by the ash discharge plates to support the refuse and ashes disposed thereabove.

19 Claims, 5 Drawing Sheets

INCINERATOR AND INCINERATING METHOD EMPLOYING THE SAME

This application is a continuation-in-part of application Ser. No. 478,396 filed Feb. 12, 1990 now U.S. Pat. No. 5,020,453.

BACKGROUND OF THE INVENTION

1. Field of the Invention

The present invention relates to an incinerator for combustion of general refuse and industrial wastes, and an incinerating method employing the same.

2. Description of the Prior Art

Heretofore proposed is a vertical incinerator having a plurality of grates dividing a furnace into a plurality of stages in such a manner that said grates can be freely opened and closed, whereby the refuse charged from the top of the furnace piles up on the grate in the first stage in a sufficient thickness thereon and is then transferred successively to the grate in the succeeding stage or stages while it is burned until it has been finally turned to ashes for discharge from the bottom of the furnace.

However, the refuse generally includes hardly combustible materials such as those rich in moisture and air-impermeable lumps, or including difficultly crushable masses, so that the combustion may not be completed in the upper combustion zone but continue in the lower combustion zone, or wherein plastics melt and drip down, and then ignite in the lower zone of the furnace. For these reasons, the grates supporting the refuse in the upper combustion zone are exposed to intense heat from the reverse surfaces and cannot be sufficiently cooled by blasting cold air against the grates, with the result that the grates tend to be thermally strained or damaged.

Furthermore, the ventilation holes in the grates may be plugged with ashes and foreign matter so as to interfere with the free passage of combustion gases and combustion air, or clinkers may be melted and stuck to the ventilation holes to impede the opening and closing of the grates.

SUMMARY OF THE INVENTION

The present invention has been accomplished for overcoming the above-mentioned disadvantages of the conventional vertical incinerator. It is, therefore, an object of the invention to provide an incinerator and an incinerating method employing the same, wherein the layer of ashes accumulated in the lower zone of a furnace is utilized as an equivalent of the grate to dispense with the grate and, thereby, simplify the equipment and insure effective utilization of combustion energy without the risk of burning out and thermal straining of the parts and the consequent troubles, thus effecting savings in running cost.

It is another object of the invention to provide an incinerator and an incinerating method employing the same, wherein both the refuse supporting means and the ash discharge means are simplified in construction to preclude insufficient operation due to intricate structure of the equipment.

It is a further object of the invention to provide an incinerator and an incinerating method employing the same, wherein refuse supporting means project into a furnace so as to effect breaking of clinker masses which tend to form on the refuse supporting means in the incineration of high calory refuse, thereby insuring complete combustion and an increased ease of discharge of the ashes.

The above and further objects, features and advantages of the invention will more fully appear from the following description with reference to the accompanying drawings. It is to be expressly understood, however, that the drawings are for purpose of illustration only and are not intended as a definition of the limits of the invention.

BRIEF DESCRIPTION OF THE DRAWINGS

FIG. 2 is a longitudinal sectional elevation view showing the refuse supporting means in retreated position and FIG. 3 is a longitudinal sectional elevation view showing the same swung into the furnace;

DETAILED DESCRIPTION OF THE PREFERRED EMBODIMENTS

Figure 1:
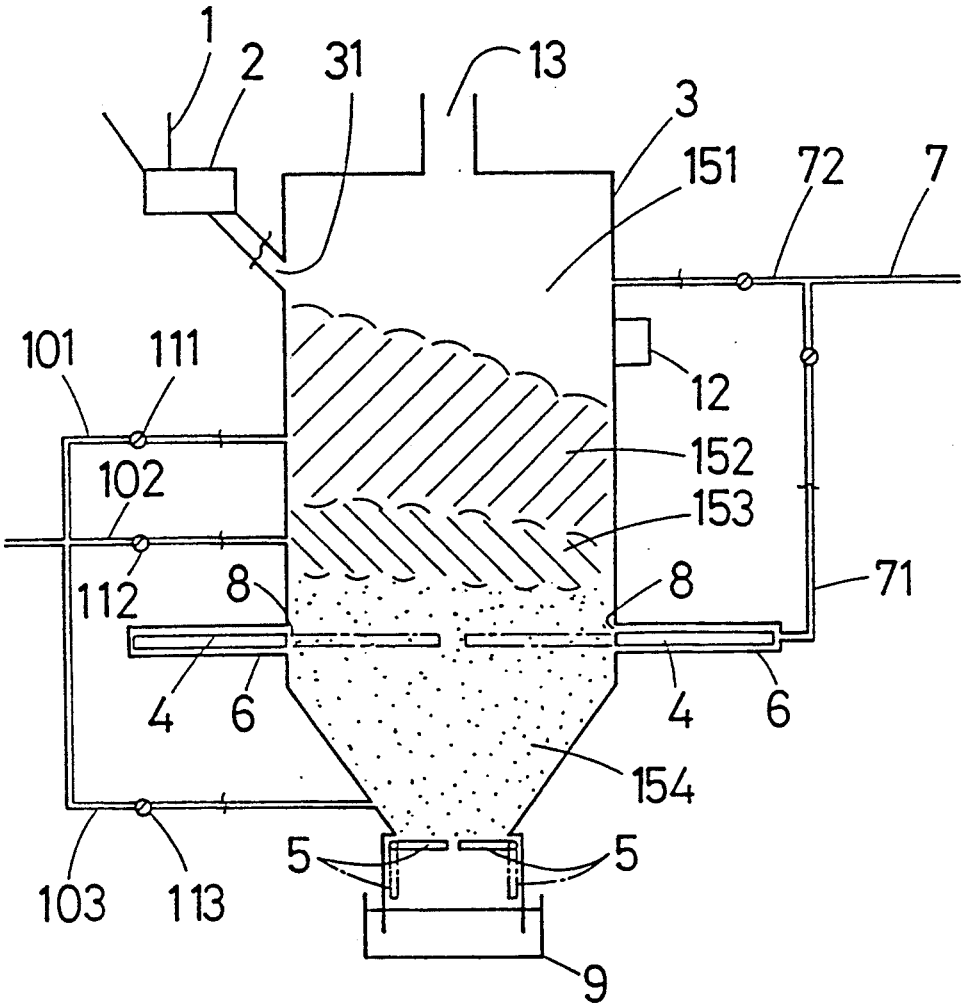
FIG. 1 is a schematic longitudinal section view showing the construction of an incinerator according to the invention.

FIG. 1 is a schematic view of the incinerator according to the invention.

In FIG. 1, the reference numeral 1 indicates a hopper. The refuse storaged in a refuse pit (not shown) is mixed well until it is crumbled to a certain extent and, then, charged into this hopper 1 by means of a crane (not shown). The hopper 1 communicates with a refuse feeding port 31 installed to an upper position of a furnace 3 through a feeder 2. The refuse charged into the hopper 1 is fed into the furnace 3 by the feeder 2 at a predetermined rate.

The furnace 3 is equipped with a pair of refuse supporting plates 4, 4 which constitute a refuse supporting means, and a pair of ash discharge plates 5, 5 which constitute an ash discharge means, in an upper position and a lower position, respectively.

The refuse supporting plates 4, 4 are displaceably installed within the furnace body 3; that is to say each is normally located in the retreated position away from the furnace 3 as illustrated. However, these plates 4, 4 are operated to project into an upper part of a layer of ashes 154 in the furnace 3 as indicated by a dot-dash line only at the time when the ash discharge plates 5, 5 are opened to discharge the ashes, thus supporting the refuse and ashes located above.

A pair of compartments 6, 6 for accommodating the refuse supporting plates 4, 4 drawn away from the furnace 3 are located on both sides of the furnace 3 at the level where the plates 4, 4 are disposed. These compartments 6, 6 are supplied with cooling air 71 from a normal temperature air source 7. This cooling air 71 blows out into the furnace 3 from clearances 8, 8 formed between the furnace 3 and the respective compartments 6, 6 to cool the refuse supporting plates 4, 4 and, at the same time, prevent entry of ashes into the compartments 6, 6 through the clearances 8, 8.

The ash discharge plates 5, 5 are each disposed rotatablely through the angle from the horizontal position to the vertical position indicated by a dot-dash line to open and close the ash discharge port at the bottom of the furnace 3. The refuse supporting plates 4, 4 then support the refuse and ashes above the upper part of the layer of ashes 154 in the lower zone of the furnace 3. Thereafter, the ash discharge plates 5, 5 are swung down to discharge the ashes into an ash transport means 9 disposed below the furnace 3. Thus, said refuse supporting plates 4, 4 are provided to assit in smooth discharge of ashes by said ash discharge plates 5, 5.

At its upper, intermediate and low levels, the furnace 3 is supplied with combustion air 101, 102 and 103, all of adjusted temperature, through dampers 111, 112 and 113 respectively. The combustion air is adjusted to an optimum temperature suited for the refuse character.

Disposed on the side opposite to the refuse feeding port 31 of the furnace 3 is an ignition burner 12 which is used for igniting the refuse at the start of operation and assisting in combustion during temperature drop in the furnace 3. Disposed at top of the furnace 3 is a gas exhaust port 13 for exit of combustion gases.

The incinerating method employing the above incinerator is now described.

In normal operation, the single charge in the interior of the furnace 3 is composed of, in correspondence with the combusting condition of the refuse, a flame layer 151, a refuse layer 152, a combustion layer 153 and an ash layer 154 from the top to the bottom.

First, the refuse charged in the hopper 1 is fed, at a predetermined rate, into the furnace 3 by the feeder 2 through the refuse feeding port 31. At the beginning of operation, the refuse is piled up on the ash layer 154 in the bottom zone of the furnace 3 and is ignited by the ignition burner 12. The refuse then starts burning with the aid of combustion air 101, 102 and the portion of refuse which is more easily combustible is turned to ashes. The ashes are accumulated together with more difficulty combustible portion of the refuse and are charged to said combustion layer 153, retaining fire seeds.

As the refuse is fed by the feeder 2 in this condition, the refuse is piled up to the refuse layer 152, gets ignited by the heat from the combustion layer 153 and the combustion air 111 and the combustion then spreads throughout the refuse layer 152 to place the furnace into a normal operating condition.

In this combustion state, the combustion gases produced in the combustion layer 153 and the lower part of the refuse layer 152 ascend through the refuse layer 152. In this prosess of ascent, the hot combustion gases promote ignition and gasification of the refuse in the upper layer and dry the raw refuse.

Then, the hot combustion gases reaching up to the flame layer 151 is recombusted by secondary air 72 from a normal temperature air source 7 and exhausted from the exhaust gas outlet 13 to the next process. The radiant heat produced by this combustion effects preliminary drying of the refuse in the refuse layer 152 and promotes burning of the paper and plastics with low ignition points to grow to fire seeds.

In this manner, the refuse descended in sequence is combusted in the refuse layer 152 and the unburnt combustibles remaining together with more difficulty combustible materials are completely combusted into ashes in the combustion layer 153 and retained in the ash layer 154.

In the ash layer 154, the combustion air 103 helps to complete the final burning of the unburnt combustibles remaining in the upper layer of the ash layer 154 and, at the same time, cools the ashes and metals having a low-melting point from below.

In this process, the air and hot combustion gases ascending from the ash layer 154 flow through the combustion layer 153 and refuse layer 152 to facilitate combustion of the refuse at the upper layer and further accelerate the drying, ignition and gasification of raw refuse.

Thus, the ash layer 154 performs the duty of the conventional fire grate.

Upon completion of this combustion of ashes, the refuse supporting plates 4, 4 are caused to project into the upper position of the ash layer 154 within the furnace 3 to support the refuse and ashes in the refuse layer 152, combustion layer 153 and ash layer 154 which are disposed above. At this time of projection, the combustion of refuse has already been completed at the level of the refuse supporting plates 4, 4. Therefore, the refuse supporting plates 4, 4 need not be provided with the ventilation holes which are required for the conventional fire grate. Moreover, because of low resistance by the refuse, the refuse supporting plates 4, 4 are allowed to project smoothly.

After the refuse supporting plates 4, 4 have thus been caused to project, the ash discharge plates 5, 5 are swung down to let the ashes below the refuse supporting plates 4, 4 fall down into the ash transport means 9.

After discharge of the ashes, the ash discharge plates 5, 5 are returned into the upper position and the refuse supporting plates 4, 4 are caused to retreat away from the furnace 3 to let the remaining ashes and the incinerator residues in the combustion layer 153 on the refuse supporting plates 4, 4 fall down onto the furnace bottom and the refuse layer 152 fall down.

The shock of this fall not only improves the air permeability in the ash layer 154 but disintegrates the unburnt masses in the combustion layer 153 and refuse layer 152 so that the whole layer becomes more permeable to air. Therefore, as the high-temperature combustion air 102, 103 is supplied, the unburnt combustibles in the ashes are easily ignited by the remaining fire seeds.

The feeding pressure of the combustion air 102, 103 need not be high because of the improved air permeability of the combustion layer 153 and ash layer 154, and the resulting improved drying efficiency helps reduce the excess air ratio.

The incinerator thus constructed not only insures almost uniform combustion of refuse at high temperature but, as aforesaid, helps reduce the excess air ratio, with the result that the volume of exhaust gas is decreased to prolong the residence time of combustion gases. This result is effective in sterilization and decomposition of dioxins. The sterilization effect, in particular, is beneficial for the incineration of medical wastes.

Furthermore, the time of projection of the refuse supporting plates 4, 4 into the furnace 3 when the temperature of the ash layer 154 has dropped and is also short in duration. Therefore, there is no risk that a thermal strain and burning out appear in the supporting plates 4, 4 due to high temperature. Moreover, the ash discharge plates 5, 5 are not adversely affected by high temperature, for the upper surfaces of the plates 5, 5 are in contact with the ashes cooled by the combustion air 103 while their lower surfaces are cooled by the atmospheric air.

Figure 2:
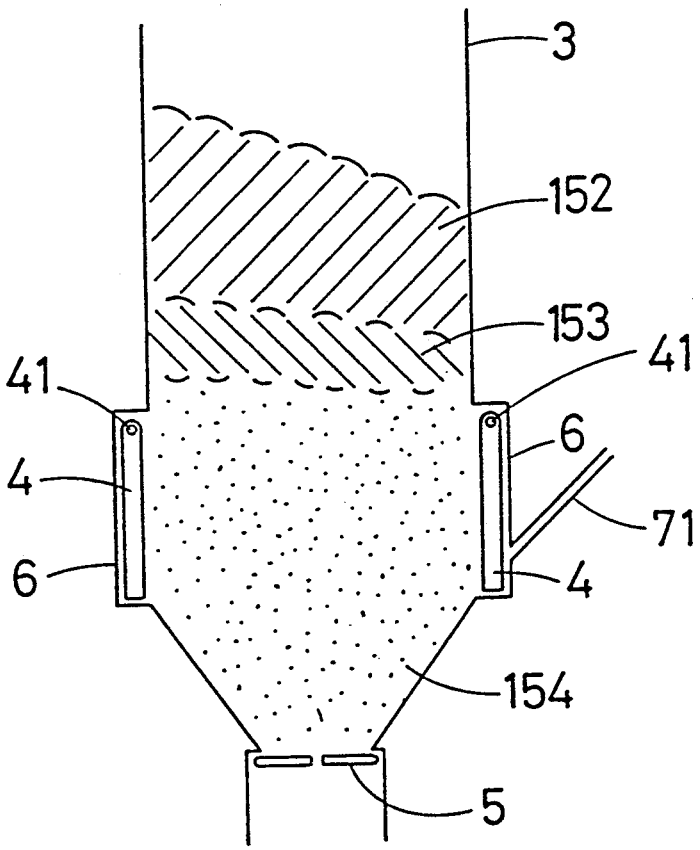
FIGS. 2 and 3 each shows an example of the refuse supporting means.
Figure 3:
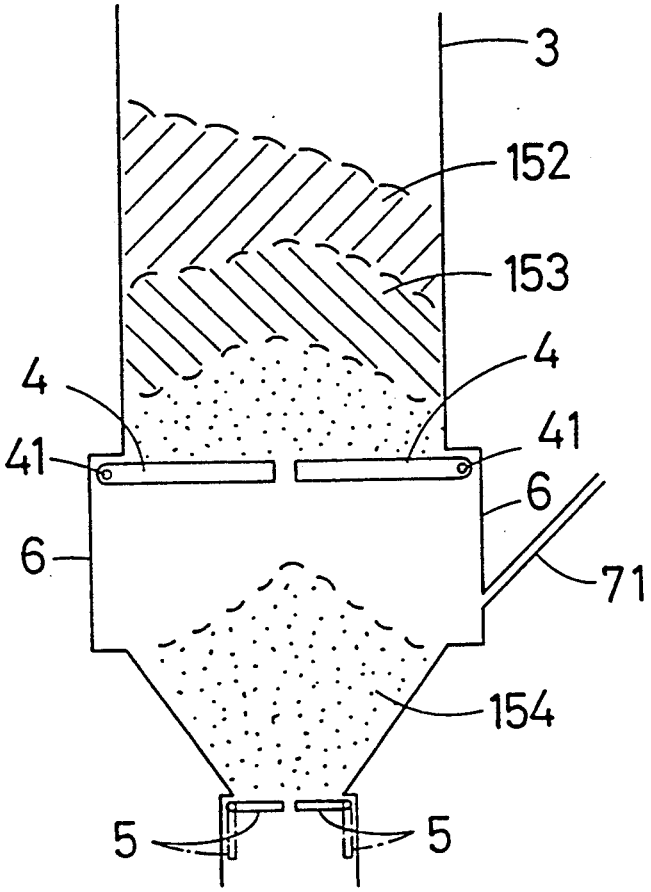
Figure 4:
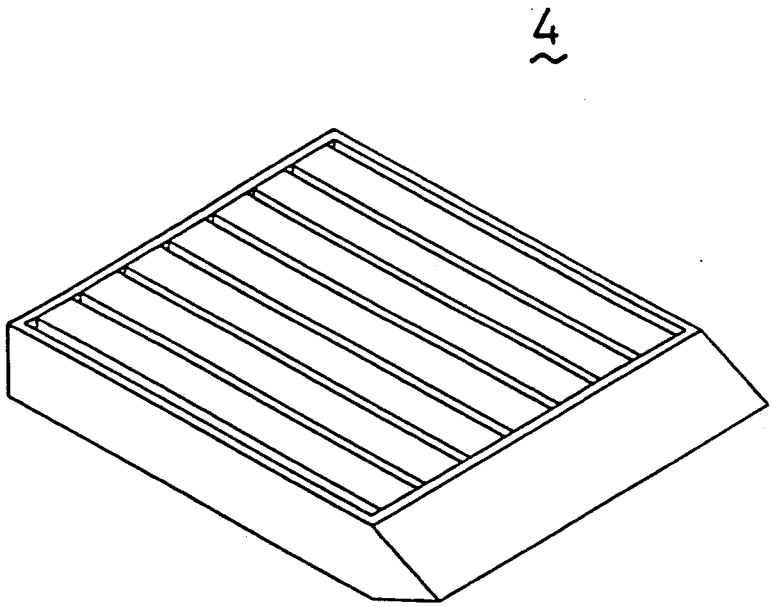
FIG. 4 is a perspective view showing another example of a refuse supporting means, which is in the form of a grate.

It should be understood that the refuse supporting plates 4, 4 need not be as described in the foregoing embodiment but may be each rotatable about a pivot 41 as illustrated in FIGS. 2 and 3. Moreover, the refuse supporting plates 4, 4 may also have a grate-like structure as illustrated in FIG. 4.

Figure 5:
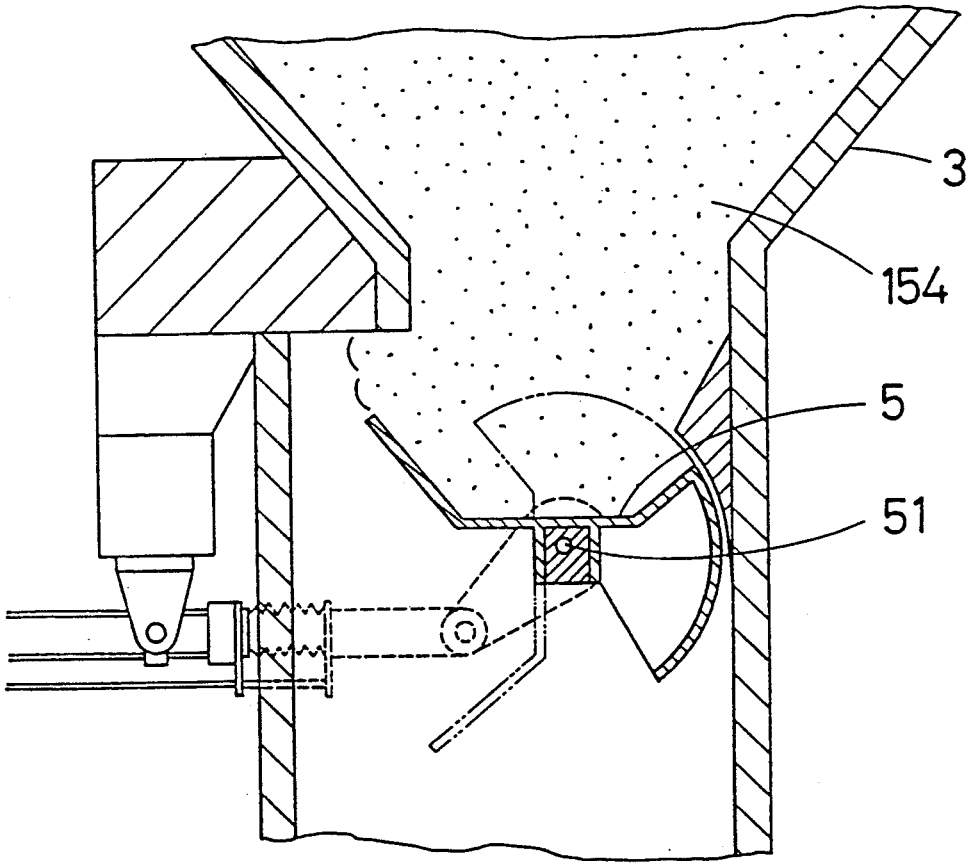
FIG. 5 is a sectional view showing another example of an ash discharge means, which is an inclined reversible grate.

The ash discharge plates 5, 5 need not be as described above in the foregoing embodiment, either, but may be an inclined reversible grate rotatable about a pivot 51 as illustrated in FIG. 5.

While there has been described what is at present considered to be preferred embodiments of the invention, it will be understood that various modifications may be made therein, and it is intended to cover in the appended claims all such modifications as fall within the true spirit and scope of the invention.

What is claimed is:

1. An incinerator for combustion of general refuse and industrial wastes comprising:

a furnace having a gas exhaust port at its top and an ash discharge port at its bottom;

a refuse feeder means communicating with said furnace for feeding refuse into an upper zone of said furnace, said refuse forming a single continuous charge in said furnace comprising from top to bottom a refuse layer, a combustion layer and an ash layer corresponding to combusting condition of each layer of said refuse;

a discharge means disposed at the bottom of said furnace in such a manner to be freely opened and closed for timely discharge of ashes that accumulate on the bottom of said ash layer; and a refuse supporting means disposed at a lower level of said furnace at an intermediate portion of said ash layer in such a manner that it can be freely displaced in a horizontal direction into said furnace so as to project into an upper part of said layer of ashes, said refuse supporting means being so displaced only at the time of discharge of ashes by said ash discharge means to support the refuse and ashes thereabove.

2. An incinerator for combustion of general refuse and industrial wastes comprising:

a furnace having a gas exhaust port at its top and an ash discharge port at its bottom;

a refuse feeder means communicating with said furnace for feeding refuse into an upper zone of said furnace, said refuse forming a single continuous charge in said furnace comprising from top to bottom a refuse layer, a combustion layer and an ash layer corresponding to combusting condition of each layer of said refuse;

a discharge means disposed at the bottom of said furnace in such a manner to be freely opened and closed for timely discharge of ashes that accumulate on the bottom of said ash layer; and a refuse supporting means disposed in a lower level of said furnace at an intermediate portion of said ash layer in such a manner that it can be freely swung into an upper part of said ash layer, said refuse supporting means being so swung only at the time of discharge of ashes by said ash discharge means to support the refuse and ashes thereabove.

3. An incinerator according to claim 1 wherein said refuse feeder means comprises a hopper for charging refuse and a feeder adapted to feed the refuse from said hopper into an upper zone of said furnace at a predetermined rate.

4. An incinerator according to claim 2 wherein said refuse feeder means comprises a hopper for charging refuse and a feeder adapted to feed the refuse from said hopper into an upper zone of said furnace at a predetermined rate.

5. An incinerator according to claim 3 which is provided with a refuse supporting means cooling means for blasting cooling air against said refuse supporting means.

6. An incinerator according to claim 4 which is provided with a refuse supporting means cooling means for blasting cooling air against said refuse supporting means.

7. An incinerator according to claim 5 further comprising a compartment for accomodating said refuse supporting means on a side wall of said furnace, said compartment communicating with said refuse supporting means cooling means so that cooling air may be blasted against the refuse supporting means via said compartment.

8. An incinerator according to claim 6 further comprising a compartment for accomodating said refuse supporting means on a side wall of said furnace, said compartment communicating with said refuse supporting means cooling means so that cooling air may be blasted against the refuse supporting means via said wall of said furnance compartment.

9. An incinerator according to claim 7 further comprising an ignition burner disposed in an opposite side to said refuse feeder means.

10. An incinerator according to claim 8 further comprising an ignition burner disposed in an opposite side wall of said furnance to said refuse feeder means.

11. An incinerator according to claim 7 wherein said refuse supporting means consists of a pair of plates for closing the furnace by displacement in a horizontal direction.

12. An incinerator according to claim 8 wherein said refuse supporting means consists of a pair of plates swingable to close the furnace in a horizontal direction.

13. An incinerator according to claim 7 wherein said refuse supporting means is in the form of a grate.

14. An incinerator according to claim 8 wherein said refuse supporting means is in the form of a grate.

15. An incinerator according to claim 7 which is further provided with means for supplying secondary air at normal temperature for recombustion of combustion gases into an upper zone of said furnace.

16. An incinerator according to claim 8 which is further provided with means for supplying secondary air at normal temperature for recombustion of combustion gases into an upper zone of said furnace.

17. An incinerator according to claim 7 wherein said ash discharge means is an inclined reversible grate.

18. An incinerator according to claim 8 wherein said ash discharge means is an inclined reversible grate.

19. An incinerating method for a furnace having an ash discharge means at a bottom thereof and a refuse supporting means disposed above said discharge means comprising the steps of:

feeding refuse from a refuse feeder means into an upper zone of said furnace to form a single continuous charge supported on said ash discharge means;

combusting the charged refuse and letting the refuse descend under its own weight so as to form an ash layer in a lower zone of the furnace, with a combustion layer and a refuse layer thereabove;

opening said ash discharge means, and causing said refuse supporting means to project into an upper part of said ash layer to support the refuse and ashes located thereabove only at each time of opening said ash discharge means at the bottom of the furnace, to discharge ashes located below the refuse supporting means from the furnace; and closing said ash discharge means at the bottom of the furnace after discharge of ashes and causing the refuse supporting means to retreat from the furnace to let the refuse and ashes supported by said refuse supporting means descend into said lower zone of the furnace to form an ash layer.

* * * * *